US006260980B1

(12) United States Patent
Ping

(10) Patent No.: US 6,260,980 B1
(45) Date of Patent: Jul. 17, 2001

(54) PICK-UP TOOL

(75) Inventor: Qiu Jian Ping, Hiangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/420,376

(22) Filed: Oct. 18, 1999

(51) Int. Cl.[7] ..... B25B 23/18
(52) U.S. Cl. ..... 362/120; 7/901; 294/65.5
(58) Field of Search ..... 81/451; 7/901; 362/119, 120; 294/65.5

(56) References Cited

U.S. PATENT DOCUMENTS

| | | | |
|---|---|---|---|
| 1,030,592 | 6/1912 | Leland . | |
| 1,269,413 | 6/1918 | Finnigan . | |
| 1,417,683 | 5/1922 | Parsons . | |
| 1,493,983 | 5/1924 | Hurley . | |
| 1,753,441 | 4/1930 | Morehouse . | |
| 2,378,775 | 6/1945 | Johnson . | |
| 2,653,636 | 9/1953 | Younkin . | |
| 2,718,806 | 6/1955 | Clark . | |
| 2,796,101 | 6/1957 | Hasemann et al. . | |
| 2,822,714 | 2/1958 | Paparelli . | |
| 2,825,374 | 3/1958 | Reid . | |
| 2,834,241 | 5/1958 | Chowning . | |
| 3,023,015 | 2/1962 | Pankow . | |
| 3,114,401 | 12/1963 | Johnson . | |
| 3,127,798 | 4/1964 | Gol . | |
| 3,384,408 | 5/1968 | Furzey . | |
| 3,630,108 | 12/1971 | Stillwagon . | |
| 3,707,894 | 1/1973 | Stillwagon, Jr. . | |
| 4,102,375 | 7/1978 | Rossini . | |
| 4,448,097 | 5/1984 | Rocca . | |
| 4,586,406 | 5/1986 | Howard . | |
| 4,779,493 | 10/1988 | White . | |
| 4,876,929 | 10/1989 | Kozak . | |
| 5,017,069 | 5/1991 | Stencel . | |
| 5,163,345 | 11/1992 | Doan et al. . | |
| 5,265,504 | 11/1993 | Fruhm . | |
| 5,309,799 | 5/1994 | Jore . | |
| 5,487,576 | 1/1996 | DuVivier . | |
| 5,593,239 | 1/1997 | Sallee . | |
| 5,732,606 | 3/1998 | Chiang . | |
| 5,749,271 | 5/1998 | Liu . | |
| 5,794,497 | 8/1998 | Anderson . | |
| 5,819,612 | 10/1998 | Anderson . | |
| 5,878,637 | 3/1999 | Liu . | |
| 5,881,614 | 3/1999 | Cheng-Tsan . | |
| 5,894,765 | 4/1999 | Anderson et al. . | |
| 5,901,622 | 5/1999 | Sweeny . | |
| 5,904,080 | 5/1999 | Anderson et al. . | |
| 5,913,596 * | 6/1999 | Lin | 362/120 |
| 6,033,082 * | 3/2000 | Lin | 362/120 |

FOREIGN PATENT DOCUMENTS

| | | |
|---|---|---|
| 718990 | 11/1954 | (GB) . |
| 6323524 | 5/1975 | (TW) . |
| 7520095 | 8/1986 | (TW) . |
| 82218332 | 12/1993 | (TW) . |

* cited by examiner

*Primary Examiner*—Stephen Husar
(74) *Attorney, Agent, or Firm*—Joseph J. Previto

(57) ABSTRACT

A tool having a handle assembly, a workpiece assembly extending from the handle assembly. The handle assembly is a flashlight mechanism, the front end of which is transparent so that lighting the flashlight will emit light through the transparent front end. The workpiece assembly has a pickup assembly associated therewith and includes a tube assembly extending from the handle assembly with the pickup assembly removably mounted within the tube assembly. The pickup assembly is extendable beyond the front end of the tube assembly and has a pickup mechanism at its front end.

15 Claims, 3 Drawing Sheets

1
2
3
4
5
10
11
12
20
21
24
30
32
33
35
40
41
42
43
44

PICK-UP TOOL

BACKGROUND

The present invention relates to a pick-up tool and more particularly to an improved pickup tool which is adapted to pick-up nails, screws, bolts, etc. and which is also adapted to be used as some other workpiece, such as a screwdriver.

Pick-up tools are used to pick-up nails, screws, bolts etc. from certain areas, such as cavities or holes in the ground or other places. They usually utilize an extendable pick up assembly having a magnet at its forward end which is used to pick-up the screws, etc. Since very little light enters such areas, the user is usually forced to use one hand to manipulate the pick-up tool and the other hand to handle a flashlight. Furthermore, in such pick-up tools the extendable pick-up assembly is mounted within an outer tubing assembly which can also be adapted to be used as a workpiece, such as a screwdriver or some other similar tool, by having a workpiece bit, such as a screwdriver bit inserted into its front end. Since the pick-up assembly is usually permanently mounted within the outer tubing assembly, the user is able to use either the pick-up assembly or the other workpiece but not both at the same time.

OBJECTS

The present invention is an improvement over existing pick-up tools and has for one of its objects the provision of an improved pick-up tool which is more versatile than existing pick-up tools.

Another object of the present invention is the provision of an improved pick-up tool in which the user may use the pick-up assembly while at the same time be able to use the tool as a workpiece by itself.

Another object of the present invention is the provision of an improved pick-up tool which has an improved mechanism for lighting the area, where screws, etc. are to be picked up.

Other and further objects will be obvious upon the understanding of the illustrative embodiment about to be described, or which will be indicated in the appended claims, and various advantages not referred to herein will occur to one skilled in the art upon employment of the invention in practice.

DRAWINGS

A preferred embodiment of the invention has been chosen for the purposes of illustration and description and is shown in the accompanying drawings forming a part of the specification wherein.

DESCRIPTION

Figure 1:
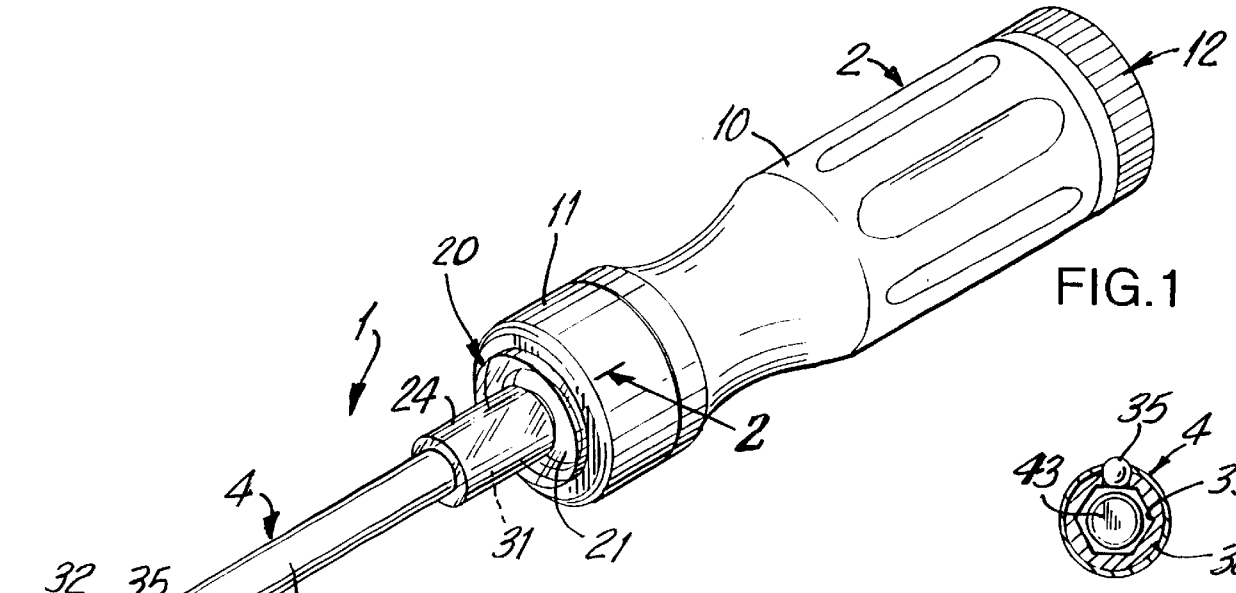
FIG. 1 is a perspective view showing the pick-up tool of the present invention.
Figure 3:
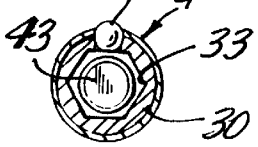
FIG. 3 is a sectional view taken along line 3—3 of FIG. 2.

Referring to the drawings and more particularly to FIGS. 1 through 5, the tool 1 of the present invention comprises a handle assembly 2, a pick-up assembly 3 and a workpiece assembly 4. The handle assembly 2 comprises a hollow casing 10, a forward cap 11 and a rear end 12. The forward cap 11 is adapted to be threadably mounted on the casing 10. The handle assembly 2 is adapted to act as a flashlight with the casing 10 having an inner cavity 13 adapted to receive a battery 14. A bulb 15 is mounted at the forward end of the cavity 13 on a contact element 16 or some other similar conducting device. The rear end of the cavity 13 has a contact 17 with a pushbutton assembly 18 to push the contact 17 forward and the usual conductive element 19 is provided along the edge of the cavity 13 to close the circuit. When the pushbutton 18 is pushed inwardly a circuit will be closed with the battery 14 and the bulb 15 will light. It will be understood that other types of battery and flashlight arrangements can be provided in the handle assembly 2 without departing from the invention.

Mounted within the cap 11 is a transparent lens assembly 20 having a flat lens 21 and a holding rim 22 which is held in place by the inturned top edge 23 of the cap 11. A transparent barrel holding cylinder 24 extends forwardly from the lens 21 and is adapted to receive the barrel 30 of the workpiece assembly 4 which is firmly imbedded therein. It will be seen that when the flashlight 10 is on, rays of light will shine through the transparent lens assembly 20.

The workpiece assembly 4 comprises the elongated barrel 30 which is permanently anchored at one end 31 to the transparent lens assembly 20 and has at its other end 32 a hexagonal or other non-circular opening 33 to receive a workpiece bit 34 such as a screwdriver bit. With the bit 34 in place in opening 33 the tool can now be used as a screwdriver. A pressure ball 35 is mounted at the front end 32 of the tube 30 and extends into the opening 33 to apply pressure to the bit 34 and prevent it from falling out. The rear end of the tube 30 has a magnet 36 mounted therein for a purpose that will be described in greater detail herein below.

Mounted within the tube 30 is the pick-up assembly 2 which comprises a plurality of telescopically assembled sleeves 40 having a metal block 41 mounted at its rear end 42 and a pick-up magnet 43 mounted in its front end 44. When the pick-up assembly 3 is mounted within the tube 30, its rear metal block 41 will be attracted to the magnet 36 in the tube 30 pick-up in order to hold the pick-up assembly 3 within the tube 30. Alternately, the block 41 may be a magnet of different polarity than magnet 36 or the block 41 may be a magnet and the element 36 may be a metal block. In this position, the front 44 of the pick-up assembly 2 can be extended beyond the front end 32 of the tube 30 and the magnet 43 can be used to pick up screws, bolts and other items from cavities in the ground or in some other place. In order to assist in locating these bolts and screws, etc., the flashlight 10 is turned on by pressing button 18 in handle assembly 2. This will emit a ray of light through the transparent lens assembly 20 (FIGS. 4 and 5) into the cavity so that the user will be able to see where the screws and bolts are located which will facilitate picking them up.

Figure 2:
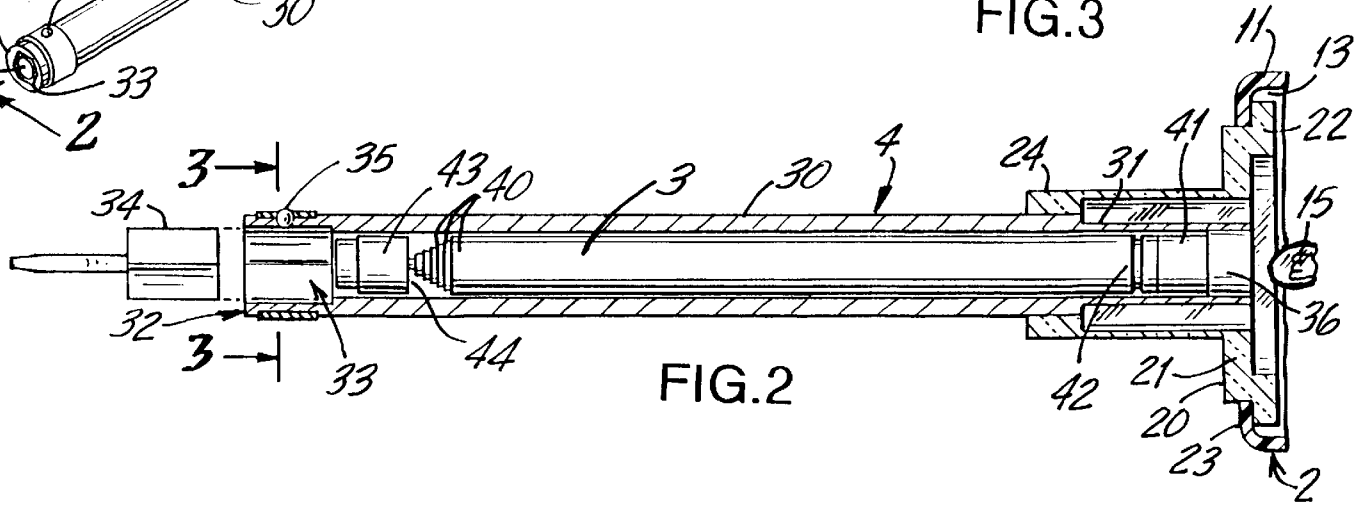
FIG. 2 is a sectional view taken along line 2—2 of FIG. 1.
Figures 4, 6:
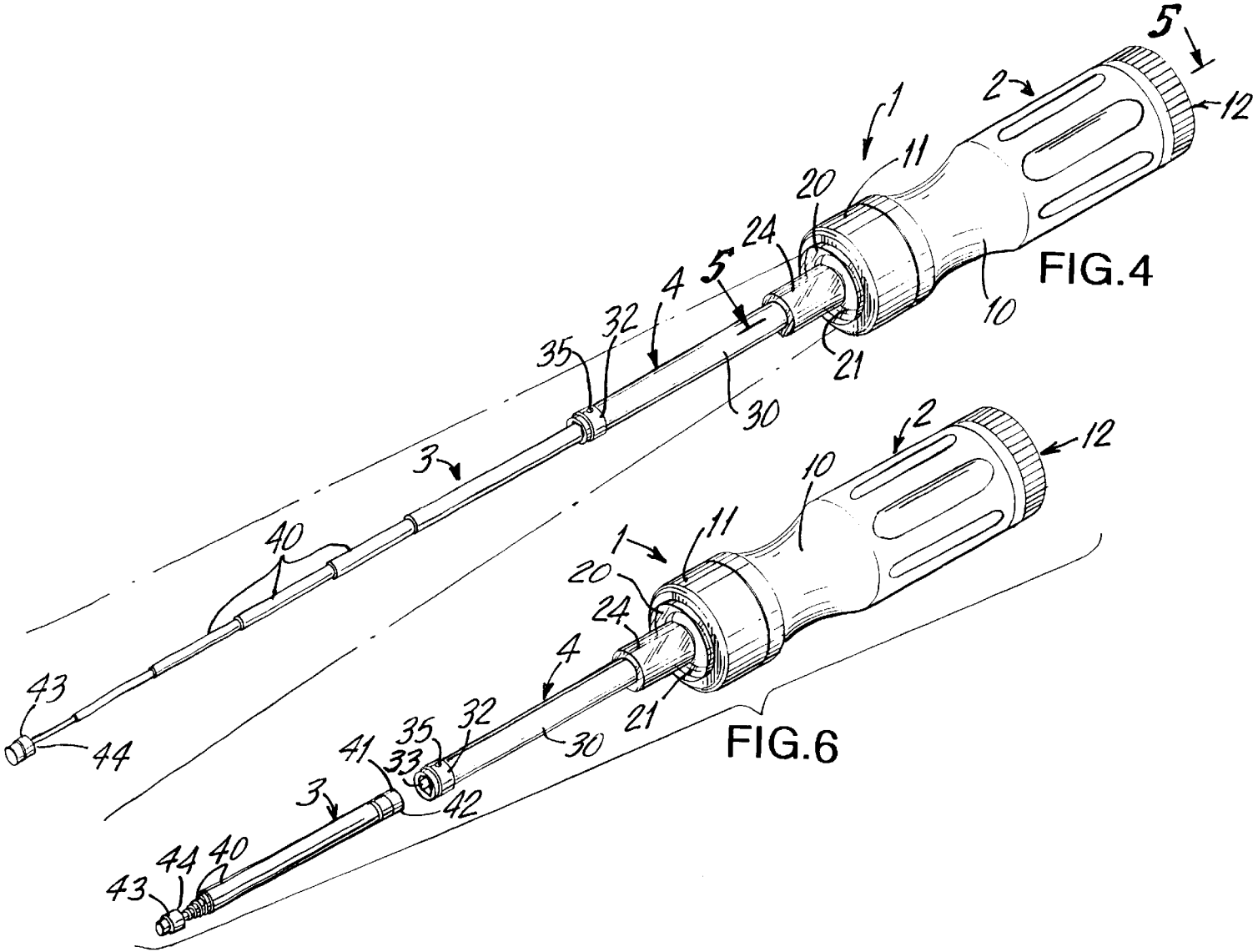
FIG. 4 is a perspective view showing the pick-up tool of the present invention in its operative position.
FIG. 6 is an exploded perspective view showing the pick-up assembly being removed from the tool.
Figure 5:
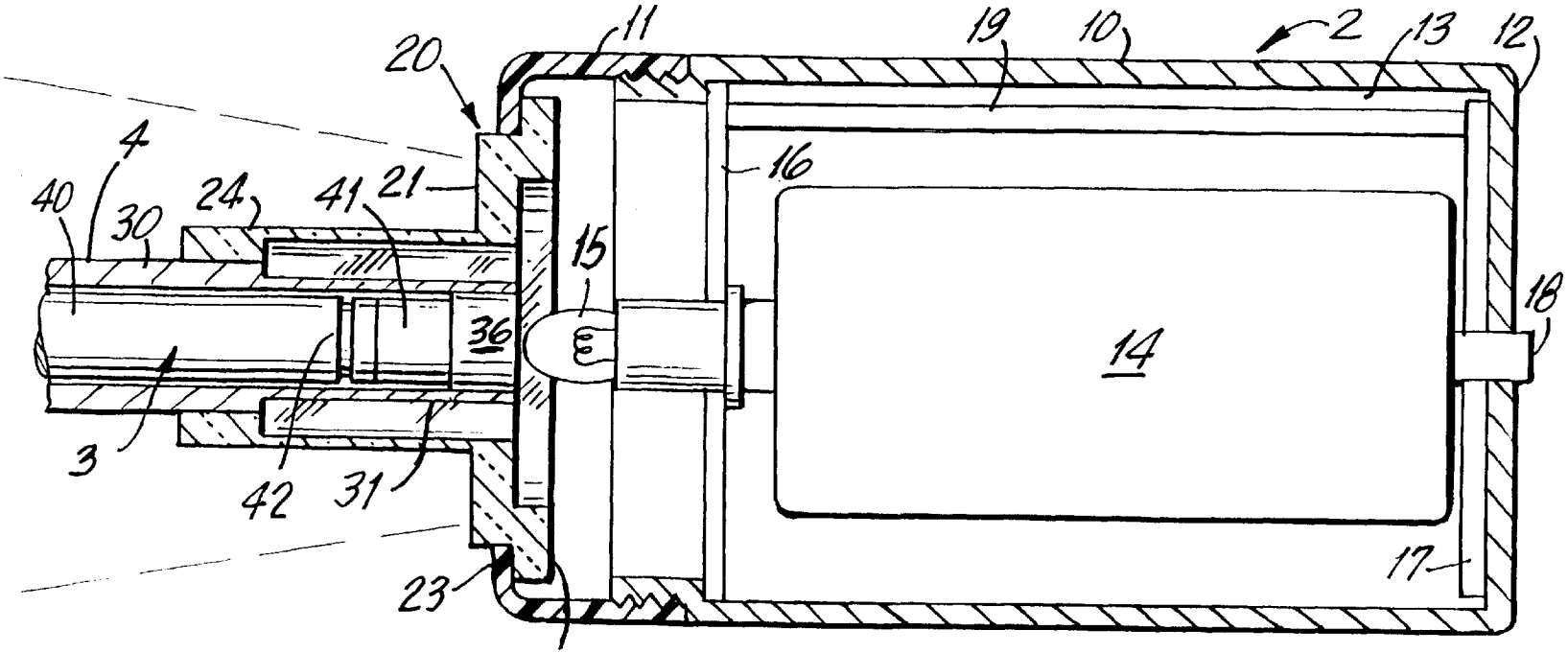
FIG. 5 is a sectional view taken along line 5—5 of FIG. 4.

With the pick-up assembly 3 mounted within the tube 30, its front magnet 43 is spaced inwardly from the front end 32 of the tubing 30. In this position the workpiece bit 34 may be inserted into the front end 32 of the tubing 30 and be held in place by the magnet 43 in combination with the ball 35 (FIG. 2). Hence in this position, the tool can be used as a workpiece such as a screwdriver.

Figure 7:
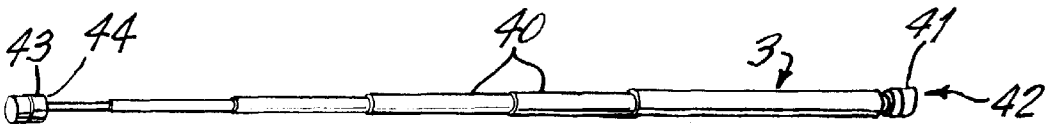
FIG. 7 is a perspective view of the pick-up assembly of the present separated from the tool.

If desired, the pick-up assembly 3 can be removed entirely from the tube 30 (FIGS. 6 and 7) and can be used independently of the workpiece assembly 4. However, even with the pickup assembly removed, the tube 30 can still operate as a different workpiece, such as a screwdriver. Hence, the user is able to use both tools at the same time. In addition, even with the pickup assembly 3 removed, the handle assembly 10 can still be used to illuminate the areas where the pickup tool 30 is used to pickup screws etc.

It will thus be seen that the present invention provides an improved pick up tool which is more versatile than existing pick up tools, which may be used both as a pick up tool and as another workpiece, such as a screwdriver either together, or separately, and which has improved means for illuminating the area where the pickup tool is to be used.

An many varied modifications of the subject matter of this invention will become apparent to those skilled in the art from the detailed description given herein above, it will be understood that the present invention is limited only an provided in the claims appended hereto.

The embodiments of the invention in which an exclusive Property or privilege is claimed are defined as follows:

1. A tool comprising a handle assembly, a workpiece assembly extending from the handle assembly, said handle assembly comprising a flashlight mechanism, the front end of the handle assembly being transparent whereby lighting the flashlight will emit light through the transparent front end, said workpiece assembly having a pickup assembly associated therewith, said workpiece assembly comprises a tube assembly extending from said handle assembly said pickup assembly being removably mounted within said tube assembly said pickup assembly having means for extending it beyond the front end of the tube assembly the front end of said pickup assembly having magnetic pickup means thereon, said pickup assembly being telescopically extendable said pickup assembly being adapted to be wholly collapsed within the tube assembly and to be telescopically extended beyond the front end of the tube assembly means in the front end of the tube assembly to hold a workpiece bit therein, and holding means for removably holding the pickup assembly within the tube assembly.

2. A tool as set forth in claim 1 wherein said holding means are magnetic means.

3. A tool as set forth in claim 2 wherein said tube assembly has metallic means therein and wherein the rear end of said pickup tool assembly has magnet means there in whereby the magnetic means will magnetically hold the pickup tool assembly within the tube assembly.

4. A tool as said forth in claim 3 wherein said pickup assembly has means for extending it beyond the front end of the tube assembly.

5. A tool as set forth in claim 4 wherein the front end of said pickup assembly has pickup means thereon.

6. A tool as set forth in claim 5 wherein said pickup means are magnetic means.

7. A tool as set forth in claim 6, wherein said pickup assembly is telescopically extendable and is mounted within said tube assembly and wherein said pickup assembly is adapted to be wholly collapsed within the tube assembly and to be telescopically extended beyond the front end of the tube assembly.

8. A tool as set forth in claim 7 wherein means are provided in the front end of the tube assembly to hold a workpiece bit therein.

9. A tool as set forth in claim 8 wherein the front of the tube assembly is non circular and is adapted to receive a workpiece bit therein.

10. A tool as set forth in claim 9 wherein the said holding means comprises a ball extending into the front end of the tube assembly.

11. A tool comprising a handle assembly, a workpiece assembly extending from the handle assembly, said workpiece assembly having a pickup assembly, a tube assembly extending from said handle assembly and said pickup assembly being removably mounted within said tube assembly, holding means for removably holding the pickup assembly within the tube assembly, said pickup assembly having means for extending it beyond the front end of the tube assembly the front end of said pickup assembly having magnetic pickup means thereon said pickup assembly being telescopically extendable, said pickup assembly being adapted to be wholly collapsed within the tube assembly and to be telescopically extended beyond the front end of the tube assembly, means in the front end of the tube assembly to hold a workplace bit therein.

12. A tool as set forth in claim 11, wherein said holding means are magnetic means.

13. A tool as set forth in claim 12, wherein said tube assembly has metallic means therein and wherein the rear end of said pickup tool assembly has magnet means therein whereby the magnet means will magnetically hold the pickup tool assembly within the tube assembly.

14. A tool as set forth in claim 13 wherein the front of the tube assembly is non circular and is adapted to receive a workpiece bit therein.

15. A tool as set forth in claim 14 wherein the said holding means comprises a ball extending into the front end of the tube assembly.

* * * * *